US007914356B2

(12) United States Patent
Nishinaka et al.

(10) Patent No.: US 7,914,356 B2
(45) Date of Patent: Mar. 29, 2011

(54) METHOD OF MANUFACTURING PLASMA DISPLAY PANEL

(75) Inventors: Masaki Nishinaka, Osaka (JP); Akinobu Miyazaki, Osaka (JP)

(73) Assignee: Panasonic Corporation, Osaka (JP)

( * ) Notice: Subject to any disclaimer, the term of this patent is extended or adjusted under 35 U.S.C. 154(b) by 322 days.

(21) Appl. No.: 11/814,701

(22) PCT Filed: Feb. 28, 2007

(86) PCT No.: PCT/JP2007/053736

§ 371 (c)(1), (2), (4) Date: Jul. 25, 2007

(87) PCT Pub. No.: WO2007/099991

PCT Pub. Date: Sep. 7, 2007

(65) Prior Publication Data

US 2010/0056010 A1 Mar. 4, 2010

(30) Foreign Application Priority Data

Feb. 28, 2006 (JP) ..... 2006-051746

(51) Int. Cl.
*H01J 9/00* (2006.01)

(52) U.S. Cl. ..... 445/25; 445/24

(58) Field of Classification Search ..... 445/24, 445/25

See application file for complete search history.

(56) References Cited

U.S. PATENT DOCUMENTS

| | | | | |
|---|---|---|---|---|
| 7,407,902 | B2 | 8/2008 | Hasegawa et al. | |
| 2005/0181927 | A1 * | 8/2005 | Hasegawa et al. | 501/79 |
| 2005/0233885 | A1 | 10/2005 | Yoshida et al. | |

FOREIGN PATENT DOCUMENTS

| | | | |
|---|---|---|---|
| EP | 1 496 025 | A1 | 1/2005 |
| EP | 1 933 355 | A1 | 6/2008 |
| JP | 2003-095697 | A | 4/2003 |
| JP | 2004-182584 | A | 7/2004 |
| JP | 2004-238273 | A | 8/2004 |
| JP | 2005-213103 | A | 8/2005 |
| JP | 2005-314136 | A | 11/2005 |
| JP | 2006-002220 | A | 1/2006 |
| JP | 2006-028334 | A | 2/2006 |

OTHER PUBLICATIONS

Japanese Search Report for Application No. PCT/JP2007/053736, dated May 1, 2007.

English translation of Form PCT/ISA/210.

Supplementary European Search Report for EP 07 71 7719, dated Jul. 14, 2008.

* cited by examiner

*Primary Examiner* — Mariceli Santiago

(74) *Attorney, Agent, or Firm* — RatnerPrestia

(57) ABSTRACT

A method of manufacturing a plasma display panel including a sealing step of arranging a front plate formed with a display electrode, a dielectric layer, and a protective layer on a transparent substrate and a rear plate formed with an address electrode, a barrier rib, and a phosphor layer so as to face each other and sealing a periphery of the front plate and the rear plate with a sealing material, where the sealing step includes a sealing material application step of applying the sealing material to the rear plate, a tentative firing step of tentatively firing applied sealing material, and a sealing step of arranging the front plate and the rear plate so as to face each other and sealing the plates by softening and melting the sealing material, and the sealing material is configured by a glass frit having bismuth oxide.

9 Claims, 3 Drawing Sheets

METHOD OF MANUFACTURING PLASMA DISPLAY PANEL

This application is a U.S. NATIONAL PHASE APPLICATION of PCT INTERNATIONAL APPLICATION PCT/JP2007/053736.

TECHNICAL FIELD

The present invention relates to methods of manufacturing a plasma display panel (hereinafter referred to as PDP), which is a flat plate display device, used in a large size television, a public display, and the like, more specifically, to a method of manufacturing a PDP in which the periphery of a front plate and a rear plate of the PDP is sealed with frit glass.

BACKGROUND ART

Since the PDP realizes higher definition and larger screen, product commercialization towards a television receiver of 65 inches class and a large public display device is advancing, and products exceeding even 100 inches are also being commercialized. In particular, the PDP for television receiver is advancing towards application to full spec high vision in which the number of scan lines is greater than or equal to twice of that of the conventional NTSC method.

The PDP is configured by a front plate and a rear plate. The front plate is formed by a glass substrate made of sodium borosilicate glass manufactured through float method, a display electrode including transparent electrode and bus electrode in stripe form formed on one of the main surfaces, a dielectric layer serving as a capacitor that covers the display electrode, and a protective layer made of magnesium oxide (MgO) formed on the dielectric layer. The rear plate is configured by a glass substrate, address electrodes in stripe form formed on one of the main surfaces thereof, a base dielectric layer that covers the address electrode, a barrier rib formed on the base dielectric layer, and phosphor layers formed between each barrier ribs to emit light of red, green, and blue.

The front plate and the rear plate have the respective electrode forming surface side facing each other, and the periphery air tightly sealed by a sealing material. The exhaust of a discharge space partitioned by the barrier rib and enclosure of discharge gas (in the case of Ne-Xe, pressure of 53.2 kPa to 79.8 kPa) are performed through exhaust pipe, which exhaust pipe is locally heated and melted (chip off) to be air tightly sealed after enclosing the discharge gas.

The finished PDP realizes color image display by selectively applying picture signal voltage to the display electrode to cause discharge, and exciting each phosphor layer with ultraviolet light generated by such discharge to emit light of red, green, and blue.

Low melting point frit glass having lead oxide as the main component is generally used for the dielectric layer of the PDP and the sealing material. The frit glass includes amorphous frit glass that does not crystallize when heated and in which the amorphous property still remains, and crystallized frit glass that crystallizes when heated. Each material has merits and demerits, and thus is selected in view of matching with the manufacturing step in most cases. When the frit glass of either the crystallized type or the amorphous type serves as the sealing material, filler is first mixed and kneaded with organic solvent to prepare sealing material in paste form. The sealing material is arranged at the periphery of at least one of the substrates of the front plate and the rear plate using film thickness printing, ink jet, or an application device equipped with a dispenser. Next, tentative firing is performed at a predetermined temperature at which the frit glass will not completely soften, so that the front plate and the rear plate are assembled while facing each other, and sealing is carried out at a sealing temperature higher than the temperature of tentative firing.

Use of no-lead material referred to as "lead free" or "leadless" that does not contain lead component even for the PDP is desired in view of recent environmental problems. An example of phosphoric acid (phosphoric acid-tin oxide etc.) sealing material and bismuth oxide sealing material that does not contain lead component is disclosed as the sealing material (see e.g., patent document 1, patent document 2 and the like). However, water resistance tends to be inferior in the sealing material having as the main component low melting point glass of phosphoric acid-tin oxide proposed as the sealing material of no-lead compared to the lead oxide sealing material used conventionally, and air tightness of the PDP cannot be substantially maintained. To this end, the bismuth oxide sealing material is getting attention as the no-lead material.

In the above-described manufacturing step of the PDP, the phosphor layers are fired in a phosphor baking oven immediately after the phosphor layers are formed on the rear plate. Thereafter, the sealing material is arranged on the peripheral edge of at least one of the substrates of the front plate and the rear plate, the sealing material of the substrate arranged with the sealing material is tentatively fired, and then the temperature is raised to the sealing temperature higher than the tentative firing temperature to soften (melt) the sealing material for air tight sealing. The phosphor layers are thus fired over a plurality of times.

The number of steps can be reduced and the steps can be simplified if the firing process immediately after the phosphor layers are formed on the rear plate is omitted and the phosphor layers are fired in the process of tentative firing and the sealing process of the sealing material.

Although the softening point temperature barely changes with respect to the heating temperature in the sealing material made of the conventional lead frit glass, the softening point temperature changes with respect to the heating temperature in the no-lead sealing material having bismuth oxide frit glass as the main component. Therefore, defects arise in the subsequent sealing if the sealing material is tentatively fired at the usual phosphor layer firing temperature.

[Patent document 1] Unexamined Japanese Patent Publication No. 2004-182584

[Patent document 2] Unexamined Japanese Patent Publication No. 2003-095697

DISCLOSURE OF THE INVENTION

A manufacturing method of a PDP of the present invention is a method of manufacturing a plasma display panel including a sealing step of arranging a front plate formed with a display electrode, a dielectric layer, and a protective layer on a transparent substrate and a rear plate formed with an address electrode, a barrier rib, and a phosphor layer so as to face each other and sealing a periphery of the front plate and the rear plate with a sealing material, wherein the sealing step includes a sealing material application step of applying the sealing material to the rear plate, a tentative firing step of tentatively firing the applied sealing material, and a sealing and bonding step of arranging the front plate and the rear plate so as to face each other and sealing the plates by softening and melting the sealing material; and the sealing material is configured by a glass frit having bismuth oxide, with properties in that the softening point temperature changes with respect to the heating temperature and rate of change of the softening point temperature differs with respect to the heating temperature, as the main component, and the tentative firing temperature in the tentative firing step is set to a temperature lower by 10° C. through 60° C. from the temperature at which the rate of change changes.

According to such manufacturing method, air tight sealing between the front plate and the rear plate is reliably performed using the sealing material that does not contain lead component, and furthermore, firing of the phosphor layers can be performed with the tentative firing step of the sealing step, whereby the number of manufacturing steps is reduced and the PDP having high reliability is achieved taking environment into consideration.

DESCRIPTION OF REFERENCE MARKS

Figure 1:
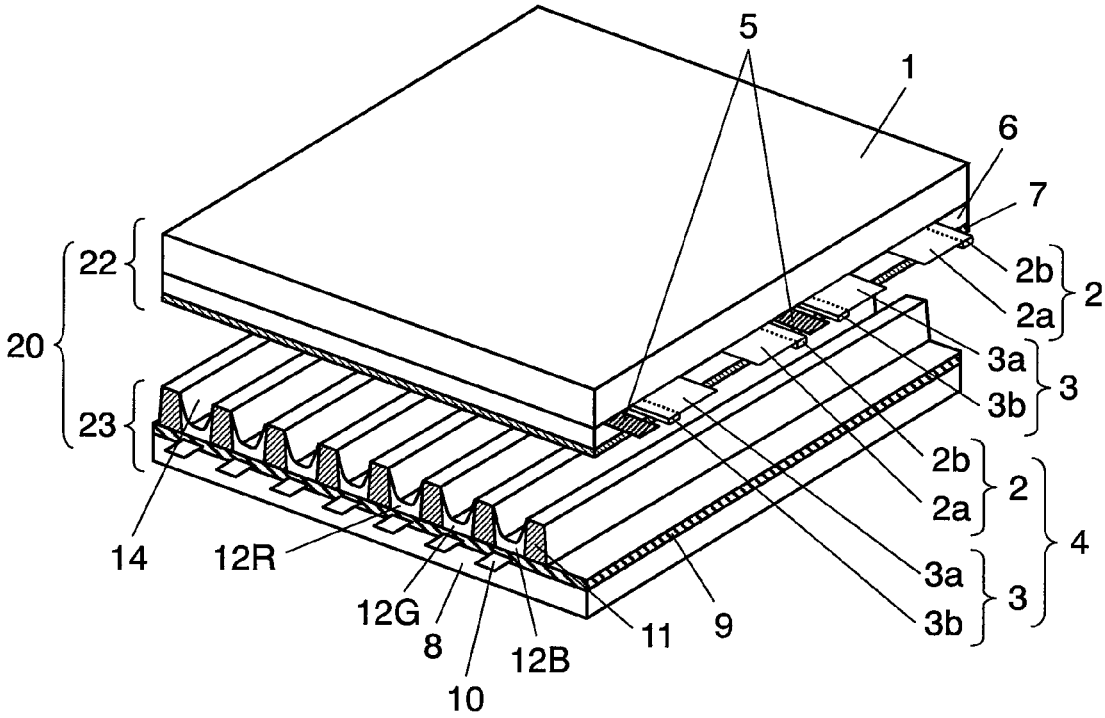
FIG. 1 is an exploded perspective view showing a configuration of a PDP according to a method of manufacturing the PDP of the embodiment of the present invention.

1 front glass substrate
2 scan electrode
2*a*, 3*a* transparent electrode
2*b*, 3*b* metal bus electrode
3 sustain electrode
4 display electrode
5 light shielding layer
6 dielectric layer
7 protective layer
8 rear glass substrate
9 base dielectric layer
10 address electrode
11 barrier rib
12R, 12G, 12B phosphor layer
14 discharge space
20 PDP
22 front plate
23 rear plate
30 narrow hole
31 exhaust tube
32 frit tablet
33 sealing material

PREFERRED EMBODIMENTS FOR CARRYING OUT OF THE INVENTION

The PDP according to the embodiment of the present invention is described in detail with reference to the drawings.

Embodiment

Figure 2A:
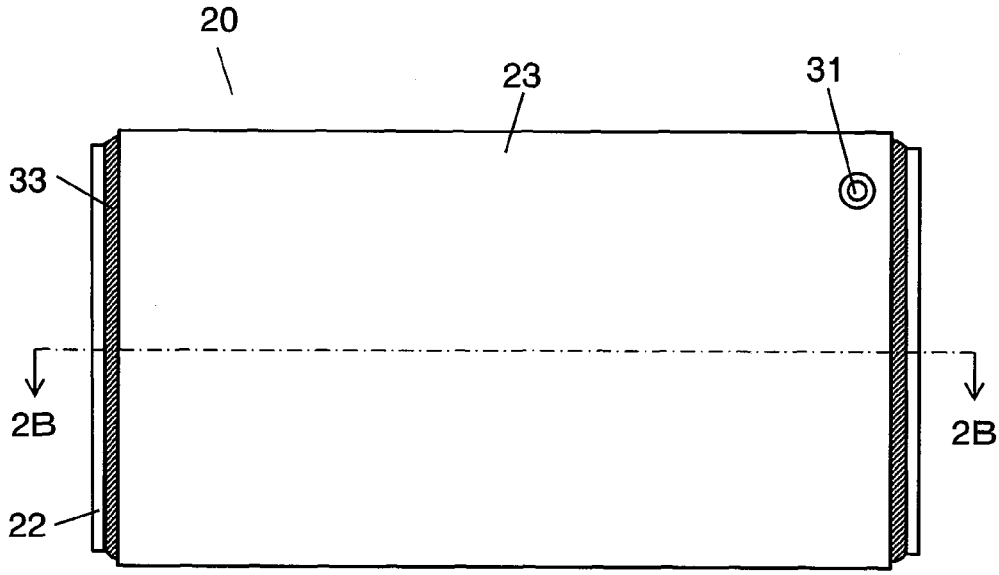
FIG. 2A is a plan view of the PDP according to the method of manufacturing the PDP of the embodiment of the present invention.
Figure 2B:
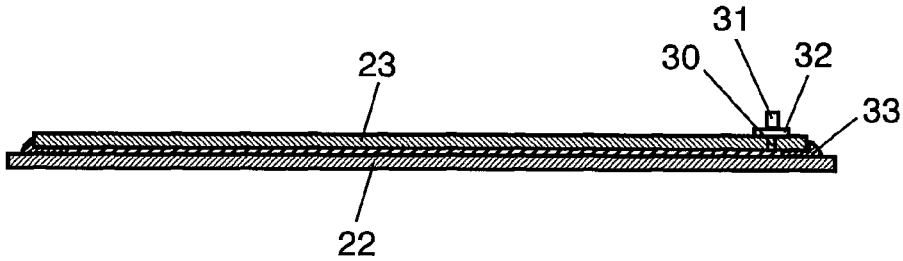
FIG. 2B is a cross sectional view taken along line 2B-2B of FIG. 2A.

FIG. 1 is an exploded perspective view showing a configuration of a PDP according to a method of manufacturing the PDP of the embodiment of the present invention. FIG. 2A is a plan view of the PDP according to the method of manufacturing the PDP of the embodiment of the present invention, and FIG. 2B is a cross sectional view taken along line 2B-2B of FIG. 2A.

The basic configuration of the PDP is similar to the general alternating current discharge type PDP. As shown in FIG. 1, FIG. 2A, and FIG. 2B, PDP 20 has front plate 22 including front glass substrate 1 and rear plate 23 including rear glass substrate 8 arranged facing each other. Furthermore, the outer peripheral part is air tightly sealed by sealing material 33 containing glass frit. Discharge gas such as neon (Ne) and xenon (Xe) is enclosed in discharge space 14 inside sealed PDP 20 at a pressure of 53.2k Pa to 79.8 kPa.

A pair of band shaped display electrode 4 including scan electrode 2 and sustain electrode 3 and light shielding layer 5 are arranged on front glass substrate 1 of front plate 22 in a plurality of columns parallel to each other. Dielectric layer 6 serving as a capacitor is formed on front glass substrate 1 so as to cover display electrode 4 and light shielding layer 5, and protective layer 7 containing magnesium oxide (MgO) is formed on the surface thereof.

A plurality of band shaped address electrodes 10 are arranged parallel to each other on rear glass substrate 8 of rear plate 23 in a direction orthogonal to scan electrode 2 and sustain electrode 3 of front plate 22, and covered with base dielectric layer 9. Barrier ribs 11 of a predetermined height for dividing discharge space 14 are formed on base dielectric layer 9 between address electrodes 10. Phosphor layers 12R, 12G, 12B that respectively emit light of red, blue, and green by ultraviolet light are sequentially applied and formed for every address electrode 10 in the groove between barrier ribs 11. A discharge cell is formed at a position where scan electrode 2 and sustain electrode 3, and address electrode 10 intersect, and the discharge cells having phosphor layers 12R, 12G, 12B of red, blue, and green lined in the direction of display electrodes 4 become the pixels for color display.

The method of manufacturing PDP 20 is described hereinafter. First, scan electrode 2 and sustain electrode 3, as well as light shielding layer 5 are formed on front glass substrate 1. Scan electrode 2 and sustain electrode 3 are respectively formed by transparent electrode 2*a*, 3*a* and metal bus electrode 2*b*, 3*b*. Transparent electrodes 2*a*, 3*a* and metal bus electrodes 2*b*, 3*b* are formed by patterning through photolithography method and the like. Transparent electrodes 2*a*, 3*a* are formed using thin film process etc., and metal bus electrodes 2*b*, 3*b* are solidified by firing paste containing silver material at a desired temperature. Light shielding layer 5 is formed through the method of screen printing paste containing black pigment or forming black pigment on the entire surface of the glass substrate and then performing patterning and firing through photolithography method.

Thereafter, the dielectric paste layer (dielectric material layer) is formed by applying dielectric paste on front glass substrate 1 through die coating method so as to cover scan electrode 2, sustain electrode 3, and light shielding layer 5. After applying the dielectric paste, the surface of the applied dielectric paste layer is leveled to become a flat surface by being left untouched for a predetermined time. The dielectric paste layer is then fired and solidified to form dielectric layer 6 covering scan electrode 2, sustain electrode 3, and light shielding layer 5. The dielectric paste is coating material containing dielectric material such as glass powder etc., binder and solvent. Protective layer 7 containing magnesium oxide (MgO) is formed on dielectric layer 6 through vacuum deposition method.

Display electrode 4 including scan electrode 2 and sustain electrode 3, light shielding layer 5, dielectric layer 6, and protective layer 7, which are predetermined components, are formed on front glass substrate 1 through the above steps, to complete front plate 22. Material containing lead is not used for each component of front plate 22 in the present embodiment of the present invention.

Rear plate 23 is formed in the following manner. First, material layer to become the component for address electrodes 10 is formed on rear glass substrate 8 through the method of screen printing paste containing silver material, method of forming a metal film on the entire surface and patterning through photolithography method etc., and then fired at a predetermined temperature to form address electrodes 10.

The base dielectric paste is applied on rear glass substrate 8 formed with address electrodes 10 through die coating method and the like so as to cover address electrodes 10 to form the base dielectric paste layer. Subsequently, the base dielectric paste layer is fired to form base dielectric layer 9. The base dielectric paste is coating material containing dielectric material such as glass powder, binder, and solvent.

The barrier ribs forming paste containing barrier rib material is applied on base dielectric layer 9 and then patterned to a predetermined shape to form a barrier rib material layer, and thereafter, fired to become barrier ribs 11. The method of patterning the barrier rib forming paste applied on base dielectric layer 9 includes photolithography method, sand blast method, and the like.

The phosphor paste containing phosphor material is applied on base dielectric layer 9 between adjacent barrier ribs 11 and the side surfaces of barrier ribs 11 on rear glass substrate 8 formed with barrier ribs 11 to form phosphor layers 12R, 12G, 12B. Rear plate 23 with predetermined components on rear glass substrate 8 is completed by firing phosphor layers 12R, 12G, 12B, but phosphor layers 12R, 12G, 12B are fired in a tentative firing step of sealing material 33 for sealing front plate 22 and rear plate 23 in the embodiment of the present invention. Materials containing lead are not used for each component of rear plate 23, similar to front plate 22.

A sealing step of air tightly sealing front plate 22 and rear plate 23 with respective electrode forming surface side facing each other at the periphery thereof with sealing material 33 is described below. In the embodiment of the present invention, the sealing step includes sealing material application step of applying and forming sealing material 33 at the peripheral edge of rear plate 23, tentative firing step of tentatively firing applied sealing material 33, and sealing and bonding step of arranging front plate 22 and rear plate 23 facing each other, and softening and melting sealing material 33 for sealing.

In the method of manufacturing the PDP according to the embodiment of the present invention, no-lead frit glass containing bismuth oxide ($Bi_2O_3$) is used as frit glass that does not contain low melting point lead component for sealing material 33. The paste sealing material in which frit glass, predetermined filler, resin and organic solvent are kneaded is used.

First, in the sealing material application step, sealing material 33 is arranged at a predetermined position on the peripheral edge of rear plate 23 using thick film printing, ink jet, or application device equipped with dispenser. Next, resin and organic solvent in the paste of sealing material 33 are removed in the tentative firing step, and the frit glass is slightly softened and tentatively fired at a predetermined temperature to fix the shape. Then, in the sealing and bonding step, front plate 22 and rear plate 23, which are arranged with respective electrode forming surface side facing each other, are entirely fired at a temperature higher than the tentative firing temperature in the tentative firing step, and the glass frit in sealing material 33 is softened so that front plate 22 and rear plate 23 are sealed and bonded. The firing process for phosphor layers 12R, 12G, 12B formed on rear plate 23 is simultaneously performed in the tentative firing step of sealing material 33 in the present invention, as previously described.

The filler has heat resistance property, and is used to adjust coefficient of thermal expansion of sealing material 33 and to control flowing state of the frit glass. In regards to the material thereof, in particular, cordierite, forsterite, β-eucryptite, zircon, mullite, barium titanate, aluminum titanate, titanium oxide, molybdenum oxide, tin oxide, aluminum oxide, silica glass etc. are preferably used alone or in combination. The sealing material may be laminated and formed in a sheet form without using thick film printing or application device in the sealing material application step of applying and forming sealing material 33.

In the sealing and bonding step of the sealing step, exhaust tube 31 arranged in exhaust narrow hole 30 provided at a predetermined position at the corner of rear plate 23 is fixed by softening and melting frit tablet 32 arranged at the periphery thereof, as shown in FIG. 2A and FIG. 2B. Frit tablet 32 is a molded body containing frit glass with the material being the same as sealing material 33.

After sealing and bonding front plate 22 and rear plate 23 and fixing exhaust tube 31, discharge space 14 partitioned by barrier rib 11 is vacuum exhausted by means of exhaust tube 31. Thereafter, discharge gas containing neon, xenon, and the like is enclosed from exhaust tube 31 at a predetermined pressure (e.g., pressure of 53.2 kPa to 79.8 kPa for Ne-Xe mixed gas). Exhaust tube 31 is then locally heated and melted (chip off) at an appropriate position to be closed so as to be air tightly sealed, thereby completing PDP 20.

PDP 20 completed with the above manufacturing method realizes color image display by selectively applying the picture signal voltage to display electrode 4 to cause discharge, and exciting each phosphor layer 12R, 12G, 12B by ultraviolet light generated by such discharge to emit light of red, green, and blue.

The sealing step of the manufacturing method of the PDP according to the embodiment of the present invention is described in detail below.

In the embodiment of the present invention, no-lead borosilicate frit glass containing at least bismuth oxide ($Bi_2O_3$) is used for sealing material 33. The composition of the no-lead frit glass containing bismuth oxide ($Bi_2O_3$) used herein is 70% by weight through 85% by weight of bismuth oxide ($Bi_2O_3$), 8% by weight through 10% by weight of zinc oxide (ZnO), 4% by weight through 6% by weight of boric acid ($B_2O_3$), 6% by weight through 8% by weight of aluminum oxide ($Al_2O_3$), and 1% by weight through 3% by weight of silicon oxide ($SiO_2$) and magnesium oxide (MgO). In particular, the softening point temperature of the glass becomes difficult to lower when the amount of bismuth oxide ($Bi_2O_3$) is too small thus causing sealing defect, and reaction with silver (Ag) in display electrode 4 and address electrode 10 occurs, and in contrast, when too large thus easily foaming. Thus, the amount is preferably set in the range of 65% by weight through 80% by weight.

Figure 3:
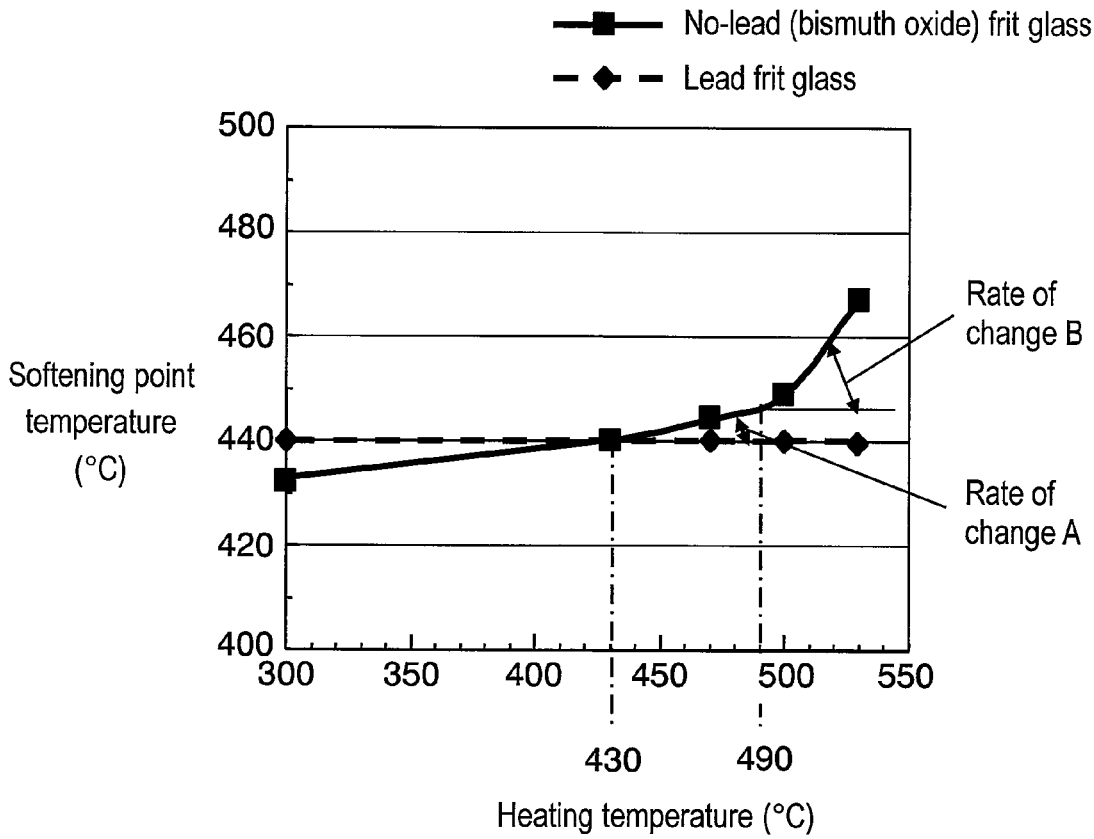
FIG. 3 is a view showing the relationship between heating temperature and the softening point temperature of the frit glass of the sealing material used in the manufacturing method of the PDP according to the embodiment of the present invention.

FIG. 3 is a view showing the relationship between heating temperature and softening point temperature of the frit glass of the sealing material used in the manufacturing method of the PDP according to the embodiment of the present invention, where the no-lead frit glass containing bismuth oxide ($Bi_2O_3$) used in the embodiment of the present invention and the conventional frit glass containing lead are respectively shown for the frit glass. The horizontal axis of FIG. 3 is the heating temperature for heating the frit glass, and shows the tentative firing temperature in the tentative firing step described above. The vertical axis is the softening point temperature measured using differential thermal analyzer (DTA).

As shown in FIG. 3, the softening point temperature is constant with respect to the heating temperature in the conventional amorphous frit glass containing lead, whereas the softening point temperature rises with rise in heating temperature in the no-lead frit glass containing bismuth oxide ($Bi_2O_3$) used in the manufacturing method of the PDP according to the embodiment of the present invention.

As shown in FIG. 3, the frit glass containing bismuth oxide ($Bi_2O_3$) has rate of change A for the change in the softening point temperature with respect to the heating temperature up to a predetermined heating temperature, and has a rate of change B steeper than the range of change A when the predetermined heating temperature is exceeded. That is, the softening point temperature changes due to change in the solid state property of the frit glass through heating, and the solid state property rapidly changes when exceeding the predetermined heating temperature. Therefore, when the frit glass is heated in the tentative firing step, the temperature for softening and melting in the following sealing and bonding step is changed by the heating temperature. In FIG. 3, the heating temperature at which the rate of change rapidly changes, that is, change in the rate of change occurs is 490° C.

As shown in FIG. 3, the softening point temperature rapidly rises when the heating temperature exceeds 490° C. This means that crystallization rapidly advances from the temperature of approx. 490° C. in the no-lead frit glass containing bismuth oxide ($Bi_2O_3$). In other words, when the tentative firing temperature in the tentative firing step is set to higher than or equal to 490° C., the softening point temperature rises since crystallization has partially started in the frit glass. Thus, when attempting to perform sealing at a temperature slightly higher than 490° C. in the sealing step, the frit glass becomes difficult to be softened and melted, and may not be sealed and bonded.

In order to soften and melt the glass frit in which crystallization has advanced and the softening point temperature has risen so as to be sealed and bonded, the sealing temperature must be a higher temperature. However, increase in sealing temperature may adversely affect re-melting of the constituting materials such as glass and alignment of electrodes, barrier ribs, and the like. In particular, since the number of electrodes increases in the high-definition PDP for full spec high vision television in which the number of scan lines is twice or more of the conventional one, the affect thereof appears significantly if the tentative firing temperature of the sealing material is raised.

Furthermore, when attempting to re-melt the partially crystallized frit glass, in particular, when the screen size of the PDP 20 is large, in-plane evenness becomes difficult to ensure in the heating process and consequently, softened and melted state of the frit becomes uneven in the plane. For instance, at the sealing temperature or a temperature slightly higher than the conventional tentative firing temperature, softening cannot be sufficiently performed, and the gap between front plate 22 and rear plate 23 becomes larger than a predetermined gap, thereby degrading display performance etc. In the state where the frit glass is crystallized, adhesive bonding of front glass substrate 1 or rear glass substrate 8 and sealing material 33 becomes inadequate, and reliable air tightness cannot be ensured.

Therefore, in the present invention, the glass frit having bismuth oxide ($Bi_2O_3$) as the main component and in which the rate of change in the change of the softening point temperature changes according to the heating temperature is used for the sealing material, and the tentative firing temperature in the tentative firing step of the sealing step is set to a temperature lower by 10° C. through 60° C. from the temperature at which the rate of change changes.

That is, tentative firing is performed in the tentative firing temperature in the range of 480° C. through 430° C., which are temperatures lower by 10° C. through 60° C. from 490° C. or the heating temperature at which the rate of change changes as shown in FIG. 3. Thus, in the sealing and bonding step, softening and melting are reliably performed and sealing and bonding is realized in a state crystallization is not advanced by simply setting the sealing temperature to a temperature higher about 10° C. from the tentative firing temperature. That is, the rate of change in the change of the softening point temperature of the frit glass becomes the region range of the rate of change A when the tentative firing temperature is between 430° C. and 480° C., and the softening point temperature becomes a low temperature of lower than or equal to 450° C. even if the next sealing temperature is a temperature of up to 490° C. Thus, even softening and melting is performed, and sealing and bonding becomes reliable.

In FIG. 3, the heating temperature of 300° C. through 490° C. is shown with one approximate line so as to be rate of change A, but rate of change of the softening point temperature with respect to the heating temperature or the change thereof varies if lower than 430° C. Thus, softening and melting of the frit glass in the subsequent sealing process sometimes becomes uneven. The lower limit of the tentative firing temperature is thus set to 430° C. in the embodiment of the present invention.

When the sealing material using the conventional frit glass containing lead of the is used, a so-called simultaneous firing in which the tentative firing step in the sealing step and the firing step of the phosphor layer applied and formed on the rear plate are the same becomes possible since the softening point temperature does not change and is constant with respect to the heating temperature, as shown in FIG. 3. That is, the softening point temperature of the frit glass containing lead is 440° C. when the temperature of firing the phosphor layers is 470° C., and does not change even if tentative firing of the sealing step is performed at 470° C. Thus, the frit glass completely softens and melts, and sealing and bonding is reliably performed if the next sealing temperature is set to 450° C.

The glass frit containing bismuth oxide ($Bi_2O_3$) as the main component is used in the present invention, and the tentative firing temperature in the tentative firing step of the sealing step is set to lower than or equal to 490° C., specifically, between 430° C. and 480° C., as described above. The firing of the phosphor layers is aimed to completely remove the resin component and the organic solvent component contained in the applied phosphor layer. To this end, firing is performed in the temperature range of between 430° C. and 480° C. to adequately and reliably remove the resin component and the organic solvent component. The resin component and the organic solvent component contained in the applied phosphor layers become difficult to be completely removed at the temperature of lower than 430° C. Thus, the tentative firing temperature is set to the temperature between 430° C. and 480° C. to ensure the reliability of firing and the reliability of sealing and bonding for the reasons described above.

In the method of manufacturing the PDP according to the embodiment of the present invention, the tentative firing temperature in the tentative firing step of the sealing material is raised and set high to the temperature at which the phosphor layers can be fired. The phosphor layer firing step of phosphor layers 12R, 12G, 12B applied and formed on rear plate 23 and tentative firing step can be performed as the same heat process, that is, in simultaneous firing. As a result, the number of manufacturing steps is reduced, and PDP of high reliability is achieved taking environment into consideration.

Moreover, since the number of electrodes increases in high-definition PDP of full spec high vision television in which the number of scan lines is twice or more of the conventional one, properties and quality of the PDP are inevitably affected as the sealing temperature in the sealing step rises. However, according to the embodiment of the present invention, the sealing temperature can be set to the temperature range that does not affect the material of glass substrate etc., and alignment of the electrodes and barrier ribs even when the no-lead frit glass containing bismuth oxide ($Bi_2O_3$) is used.

In the above embodiment, exhaust tube 31 or frit tablet 32 may have a material composition that does not contain lead, similar to sealing material 33, and thus PDP is achieved that takes environment into consideration.

In a precise sense, the no-lead frit glass containing bismuth oxide ($Bi_2O_3$) used in the manufacturing method of the PDP according to the embodiment of the present invention described above is not completely leadless, and although lower than or equal to 500 PPM in analysis, a very small amount of lead is still detected. However, lead is assumed as not contained if lower than or equal to 10000 PPM in the regulation of EC-RoHS directive related to environment in Europe, and expressions such as "not contain lead" or "no-lead" are used in the embodiment of the present invention.

INDUSTRIAL APPLICABILITY

As described above, the PDP of the present invention realizes PDP having improved sealing reliability and excelling in display quality taking environment into consideration, and is effective in large screen display devices.

The invention claimed is:

1. A method of manufacturing a plasma display panel comprising a sealing step of:

arranging a front plate formed with a display electrode, a dielectric layer, and a protective layer on a transparent substrate and a rear plate formed with an address electrode, a barrier rib, and a phosphor layer so as to face each other; and sealing a periphery of the front plate and the rear plate with a sealing material, the sealing step including:

a sealing material application step of applying the sealing material to the rear plate;

a tentative firing step of tentatively firing the applied sealing material at a tentative firing temperature; and a sealing and bonding step of arranging the front plate and the rear plate so as to face each other and sealing the plates by softening and melting the sealing material, wherein the sealing material is configured by a glass frit having bismuth oxide, with properties in that a softening point temperature changes with respect to a heating temperature and a rate of change of the softening point temperature differs with respect to the heating temperature, as the main component, the sealing material exhibiting a crystallization temperature at which crystallization starts; and wherein the tentative firing temperature in the tentative firing step is 10° C. through 60° C. lower than the crystallization temperature at which crystallization of the sealing material starts.

2. The method of manufacturing the plasma display panel according to claim 1, wherein the tentative firing temperature of the tentative firing step is higher than or equal to 460° C. and lower than or equal to 480° C.

3. The method of manufacturing the plasma display panel according to claim 1, wherein the crystallization temperature at which crystallization of the sealing material starts is approximately 490° C.

4. The method of manufacturing the plasma display panel according to claim 1, wherein the bismuth oxide of the sealing material is in the range of 65% by weight through 80% by weight.

5. The method of manufacturing the plasma display panel according to claim 4, wherein the tentative firing temperature of the tentative firing step is higher than or equal to 460° C. and lower than or equal to 480° C.

6. The method of manufacturing the plasma display panel according to claim 4, wherein the crystallization temperature at which crystallization of the sealing material starts is approximately 490° C.

7. The method of manufacturing the plasma display panel according to claim 1, wherein a phosphor layer firing step of firing the phosphor layer formed on the rear plate is simultaneously performed with the tentative firing step.

8. The method of manufacturing the plasma display panel according to claim 7, wherein the tentative firing temperature of the tentative firing step is higher than or equal to 460° C. and lower than or equal to 480° C.

9. The method of manufacturing the plasma display panel according to claim 7, wherein the crystallization temperature at which crystallization of the sealing starts is approximately 490° C.

* * * * *